US011666110B1

(12) United States Patent
Panzer

(10) Patent No.: US 11,666,110 B1
(45) Date of Patent: Jun. 6, 2023

(54) HEAD WRAP ASSEMBLY

(71) Applicant: Lacretia Panzer, Prescott, WI (US)

(72) Inventor: Lacretia Panzer, Prescott, WI (US)

( * ) Notice: Subject to any disclaimer, the term of this patent is extended or adjusted under 35 U.S.C. 154(b) by 0 days.

(21) Appl. No.: 17/226,278

(22) Filed: Apr. 9, 2021

Related U.S. Application Data

(60) Provisional application No. 63/008,362, filed on Apr. 10, 2020.

(51) Int. Cl.
*A42B 1/22* (2006.01)

(52) U.S. Cl.
CPC ..... *A42B 1/22* (2013.01)

(58) Field of Classification Search
CPC ..... A42B 1/041; A42B 1/049; A42B 1/04; A42B 1/22; A42B 1/06; A42B 1/225; A42B 5/00; A42B 1/0182; A42B 1/205; A42B 1/0189; A42B 3/10; A42B 1/0186; A42B 7/00; A41D 23/00; A41D 20/00; A45D 8/40
USPC ..... 2/207
See application file for complete search history.

(56) References Cited

U.S. PATENT DOCUMENTS 1,534,421 A * 4/1925 Smith ..... A42B 1/22 D2/885
2,107,951 A * 2/1938 Lipton ..... A42B 1/041 2/171.7
2,666,925 A * 1/1954 Mayer ..... A42B 1/041 D2/878
6,467,096 B1 * 10/2002 Coluccio ..... A42B 1/22 2/195.2
2004/0128739 A1 * 7/2004 Tufano-Sisca ..... A42B 1/225 2/209.3
2015/0230527 A1 * 8/2015 Branson ..... A41D 23/00 2/181
2017/0360138 A1 * 12/2017 Guice ..... A42B 1/206
2019/0223538 A1 * 7/2019 Berg ..... A47H 13/00

FOREIGN PATENT DOCUMENTS

DE 20015070 U1 * 1/2002 ..... A42B 1/041
DE 202014008063 U1 * 2/2015 ..... A42B 1/247

* cited by examiner

*Primary Examiner* — Katherine M Moran
*Assistant Examiner* — Grady Alexander Nunnery
(74) *Attorney, Agent, or Firm* — Eggink & Eggink; Katrina M. Eggink; Anthony G. Eggink

(57) ABSTRACT

A head wrap assembly having a flexible, unitary body having a headband portion with two cooperating flaps or wings extending therefrom. The headband portion is constructed to be placed circumferentially around the head of a wearer and having an elastic cord secured therein that can be cinched at the nape of a wearer's neck to secure the headband on a wearer's head. Each flap or wing has a wing-like configuration and is attached along one side to the headband and has an endpoint or terminal tip that is located at the other end of the wing and thus spaced from the headband portion. In a preferred embodiment, a magnet is located within the endpoint or terminal tip of each wing and secures each wing around the head of a wearer by magnetically engaging a magnet contained in the headband. A flap structure having a pocket may be also attached along one side to the headband structure to contain the hair of a wearer.

19 Claims, 11 Drawing Sheets

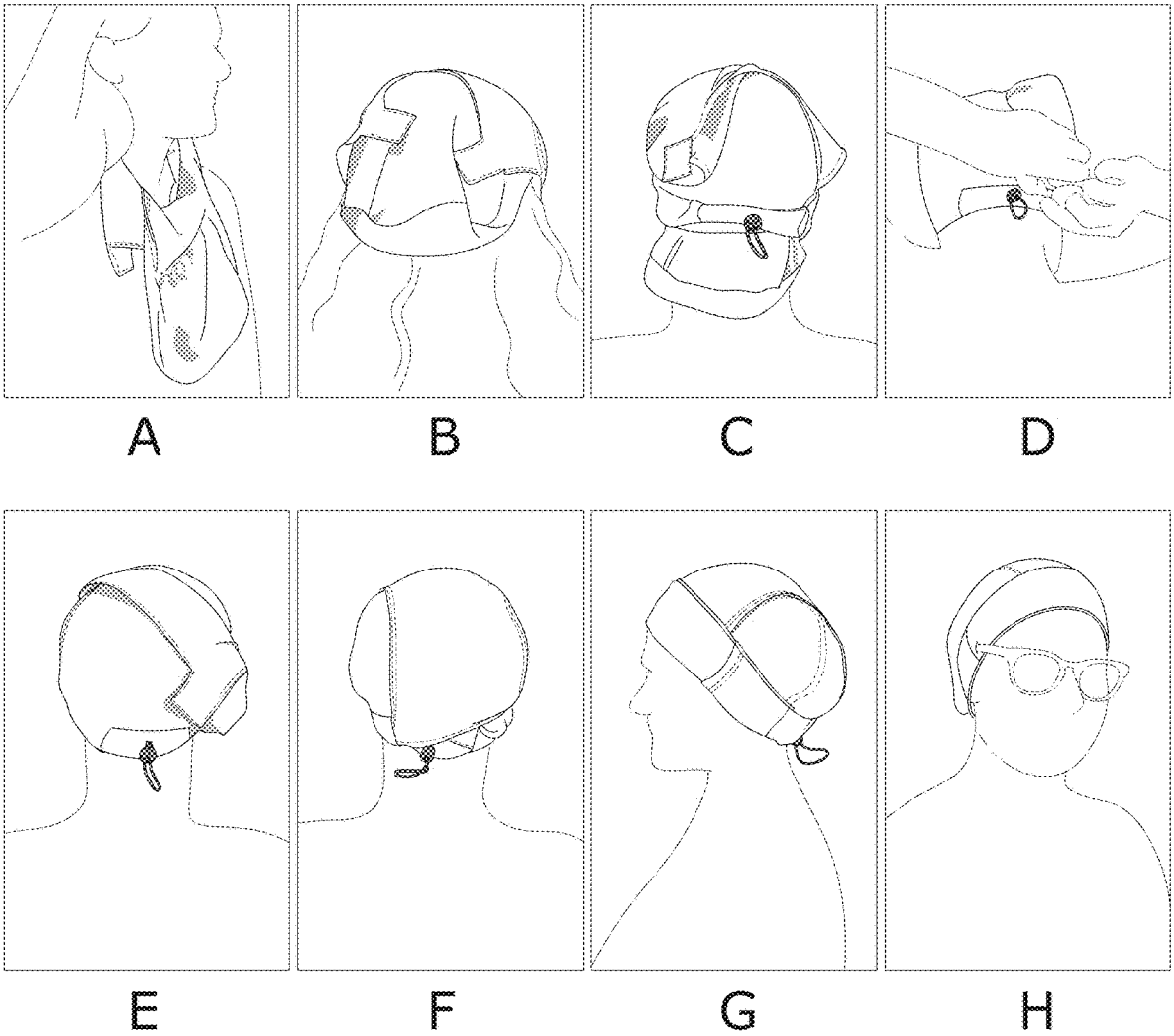
FIG 11 A-H

HEAD WRAP ASSEMBLY

This application claims the benefit of U.S. Provisional Application Ser. No. 63/008,362, filed Apr. 10, 2020, and which is fully incorporated by reference herein.

BACKGROUND OF THE INVENTION

The present invention relates generally to a head wrap assembly. Specifically, the present invention relates to an adjustable wrap for a wearer's head for covering, containing and protecting a wearer's head and hair.

Many occasions exist where covering a person's head and hair is desired, for example, for sanitary, recreation or religious reasons. Manufacturing, food processing, medical or restaurant workers may want or need to cover their hair for safety and sanitary reasons. A motorcycle rider may wish to contain and preserve their hair underneath a helmet and/or while riding on a motorcycle. A person may also wish to cover their hair for religious reasons or while playing a sport with or without a helmet.

Prior art head coverings have various shortcomings, for example, they do not properly remain on a wearer's head, needing readjustment, they are uncomfortable and/or they are overly complicated to apply to a wearer's head.

Accordingly, there exists a need for a head and hair covering that is easy to use, and stays on a wearer's head without the disadvantages of the prior art as described above.

SUMMARY OF THE INVENTION

The head wrap assembly of the present invention has a flexible, unitary body having a headband portion with two cooperating flaps or wings extending therefrom. The headband is constructed to be placed circumferentially around the head of a wearer and having an elastic cord secured therein that can be cinched at the nape of a wearer's neck to thereby secure the headband on the wearer's head. The headband portion or structure has two openings or pockets therein each having or containing a fastening member, e.g. a magnet or hook, secured within the opening. Each opening or pocket having the fastening member may be located approximately behind wearer's ears. Each flap or wing has a wing-like configuration and is attached along one side to the headband portion and has an endpoint or tip that is located at the other end of the wing and thus spaced from the head band. A cooperating fastening structure, e.g. a magnet or fabric loop, is located at or within the endpoint or tip of each wing and corresponds with the fastening structure within each opening on the headband and located approximately behind a wearer's ear. A flap structure having a pocket may also be attached along one side to the headband structure so that the pocket is located along the side that is opposite the side attached to the headband structure and, thus, the pocket is spaced from the headband.

In use, a wearer pulls the headband portion over their head with the wings and flap towards their face and in front of their body and with the headband cinch towards the nape of their neck and back of their body, places the headband around their neck, and pulls their hair through the headband, if applicable. A wearer next pulls the headband upwards and onto their head with the wings and flap towards their forehead/front hairline and with the cinch positioned at the nape of their neck. A wearer next tightens the cinch at the nape of their neck to secure the headband on their head. If applicable, a wearer next tucks their hair into the hair flap and pocket. Next, a wearer grasps the end/tip of a wing, wraps the wing around their head, and tucks the end through a loop and into the opposite side opening on the headband. The magnet or fastener contained in the end of the wing tip and the magnet or corresponding fastener secured within the opening of the headband magnetically or otherwise engage to hold the wing structure in place. The wearer then grasps the end/tip of the other wing and wraps the wing around their head and secures the end/tip of the wing in the opening of the headband portion on the opposite side of their head using the corresponding magnets or other fasteners secured respectively therein.

Another embodiment of the head wrap assembly of the invention is constructed for use with a wearer who is wearing their hair in a style having one or more pigtails or braids. The head wrap assembly has a unitary flexible body made of a headband portion with two wing structures attached thereto. Each wing structure has an elongated end that may be wrapped into a braid or pigtail of a wearer. The headband portion is constructed to be placed circumferentially around the head of a wearer and has an elastic cord secured therein that can be cinched at the nape of a wearer's neck to secure the headband on the wearer's head.

In another embodiment of the present invention, a headband structure with a cinch has a head covering attached thereto thereby creating a beanie-like structure. All embodiments of the headband structure may include eyelets in the headband structure for a user to place the ends of eyeglasses therethrough. A fabric covering may extend along the headband to cover each eyeglass eyelet. Each headband may also include a lining that has moisture-wicking properties and the headband portion and corresponding head wrap assembly may be constructed of UV resistant material and/or anti-flammable material as needed or desired by a wearer.

It is a benefit of the present invention to provide a head wrap assembly that is adjustable, easy to use and stays securely in place once a user places it on their head. It is a further benefit of the invention to provide a head wrap assembly that is unitary and can be worn under a helmet, for example, a motorcycle helmet. It is yet another benefit of the invention to provide a head wrap assembly that accommodates many different hair styles and may preserve a hairstyle tor a wearer while riding a motorcycle, for example.

These and other benefits of this invention will become clear from the following description by reference to the drawings.

BRIEF DESCRIPTION OF THE DRAWINGS

FIGS. 11A-11H are photographs showing the head wrap assembly of FIG. 1 in use;

DESCRIPTION OF THE PREFERRED EMBODIMENTS

The head wrap assembly of the present invention comprises an adjustable headband having a plurality of novel features. Variations of the headwrap assembly are provided based on the preferences of the user and/or the hair type, hair length and hair style of the wearer. An embodiment of the head wrap assembly is shown and described with respect to FIGS. 1-11. Another embodiment of the head wrap assembly is shown and described with respect to FIGS. 12-15 and which is constructed to be worn by a user wearing pigtails or ponytails in their hair. Another embodiment of the head wrap assembly is shown and described with respect to FIGS. 16-18 and which is a beanie style head wrap.

Figure 6:
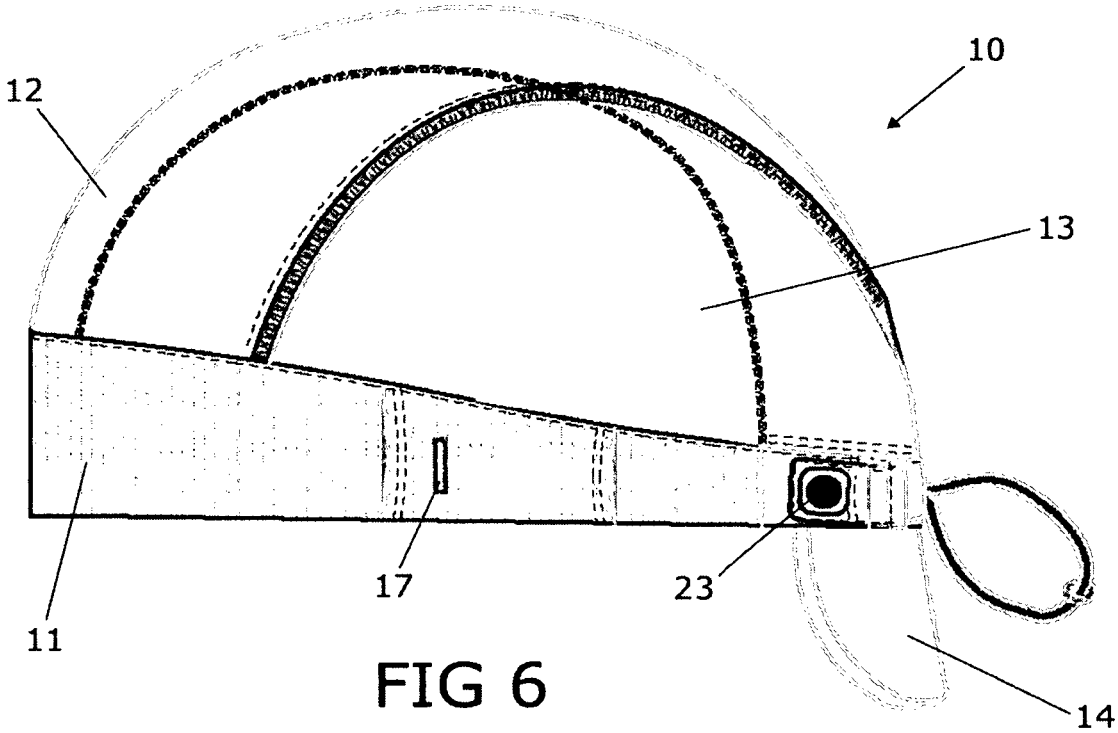
FIG. 6 is an internal view of FIG. 5.
Figure 7:
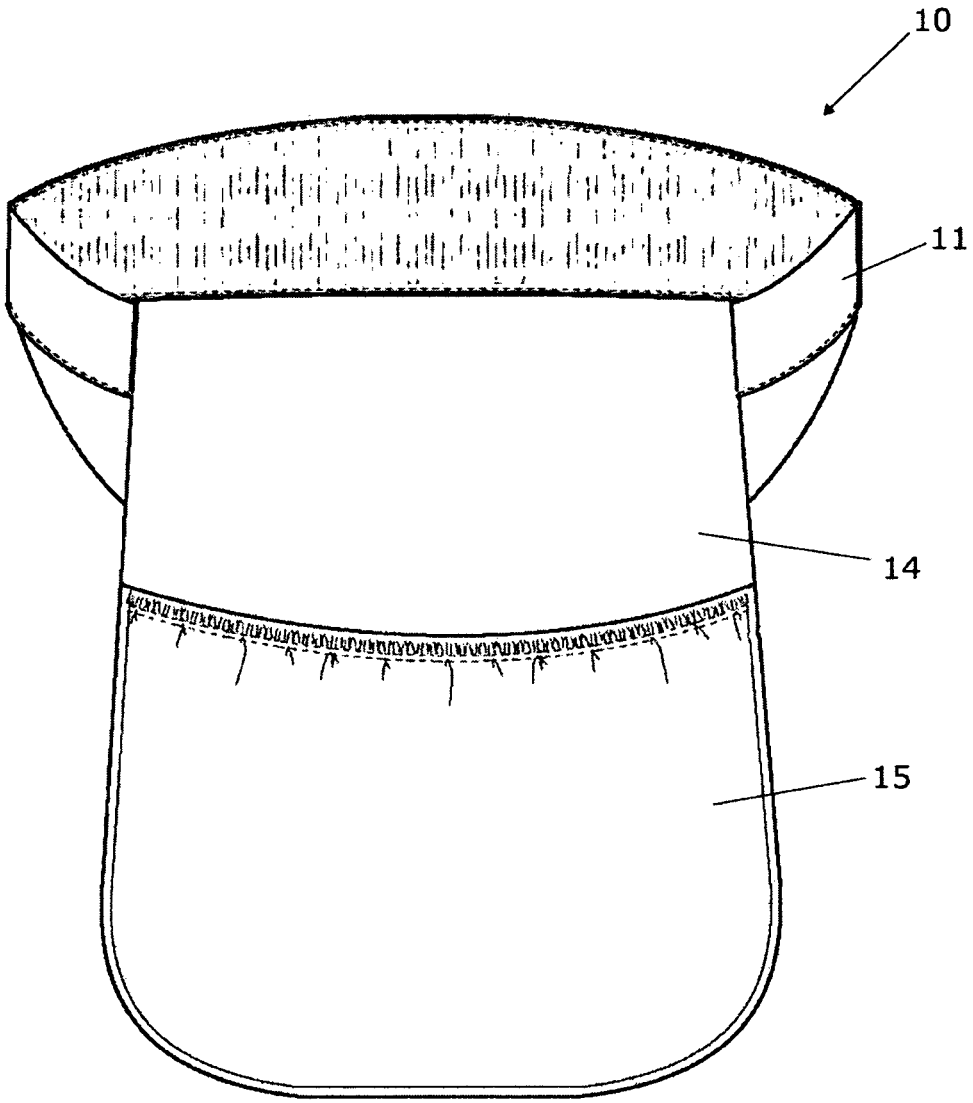
FIG. 7 is a bottom view of the head wrap assembly of FIG. 1.
Figure 8:
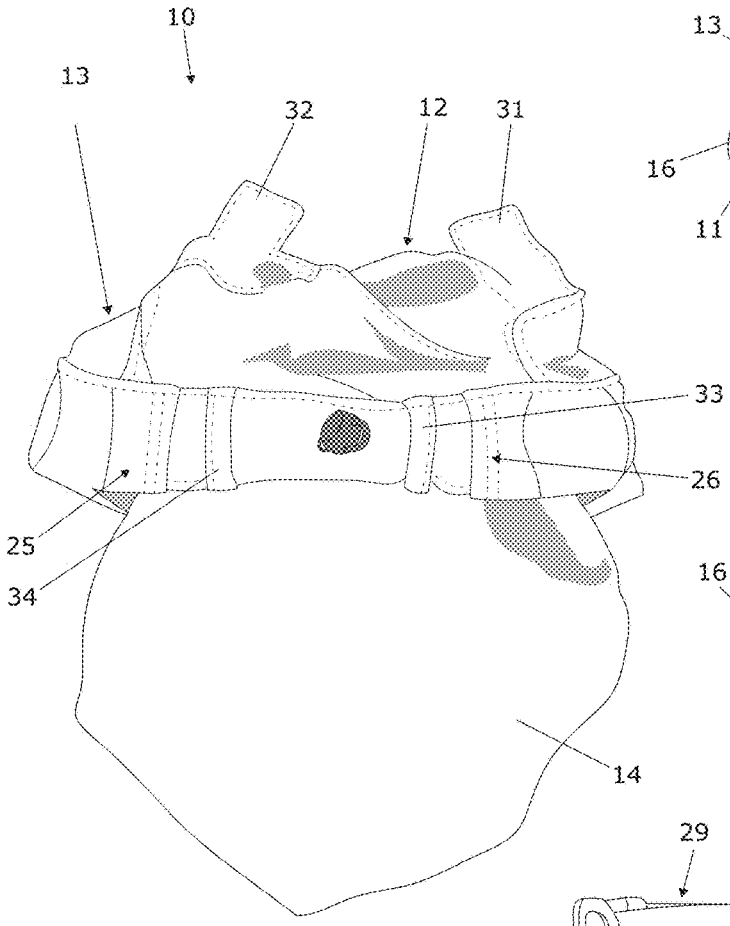
FIG. 8 is a perspective view of the embodiment of FIG. 1.
Figure 9:
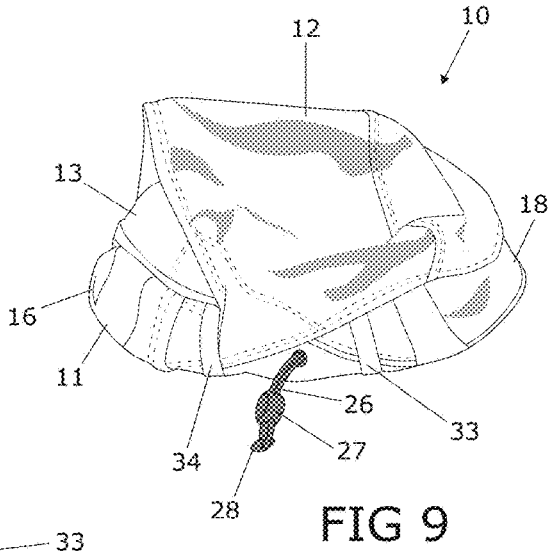
FIG. 9 is another perspective view of the embodiment of FIG. 1.
Figure 10:
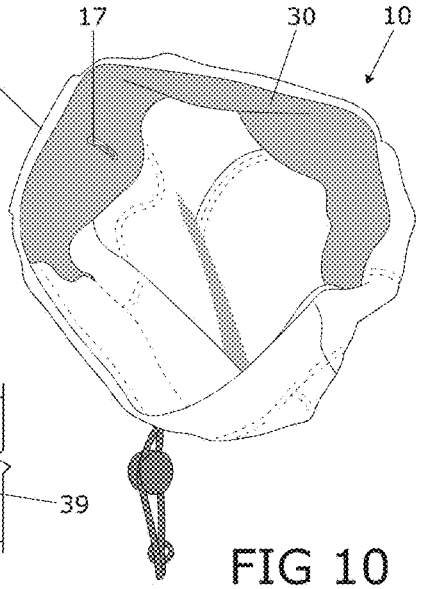
FIG. 10 is another perspective view showing the inside of the embodiment of FIG. 1.
Figure 8A:
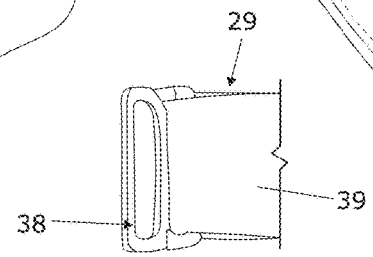
FIG. 8A is a perspective view of an alternate flap fastening means of the embodiment of FIG. 1.
Figure 12:
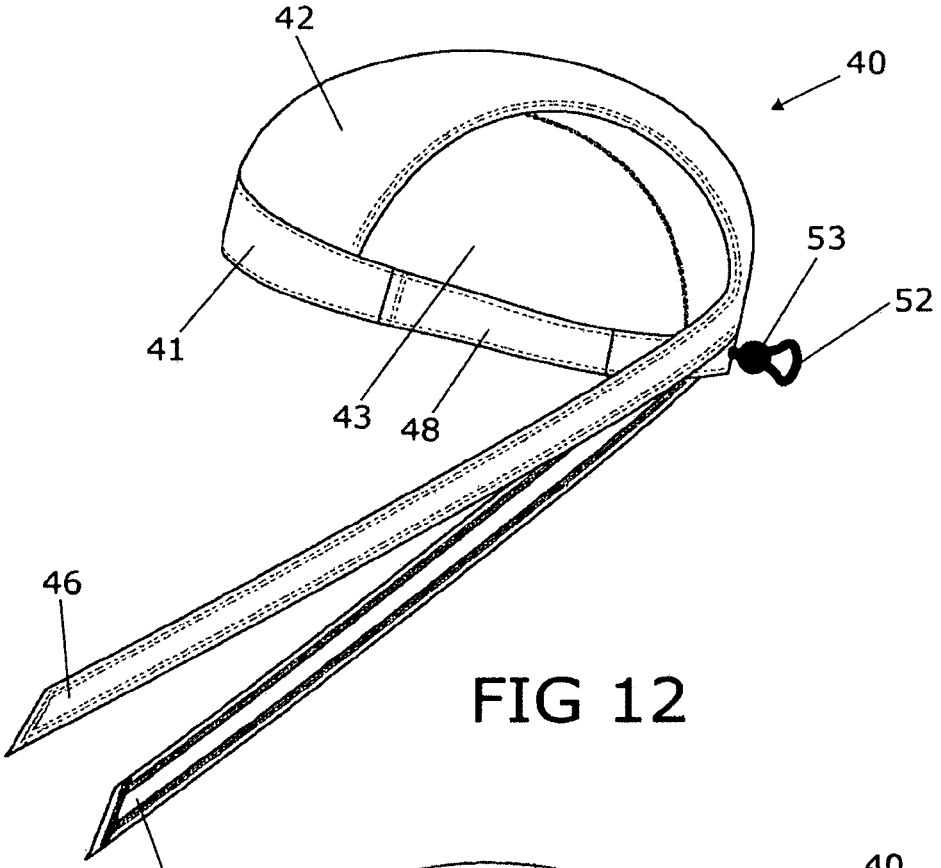
FIG. 12 is a left side view of another embodiment of a head wrap assembly of the invention.
Figure 13:
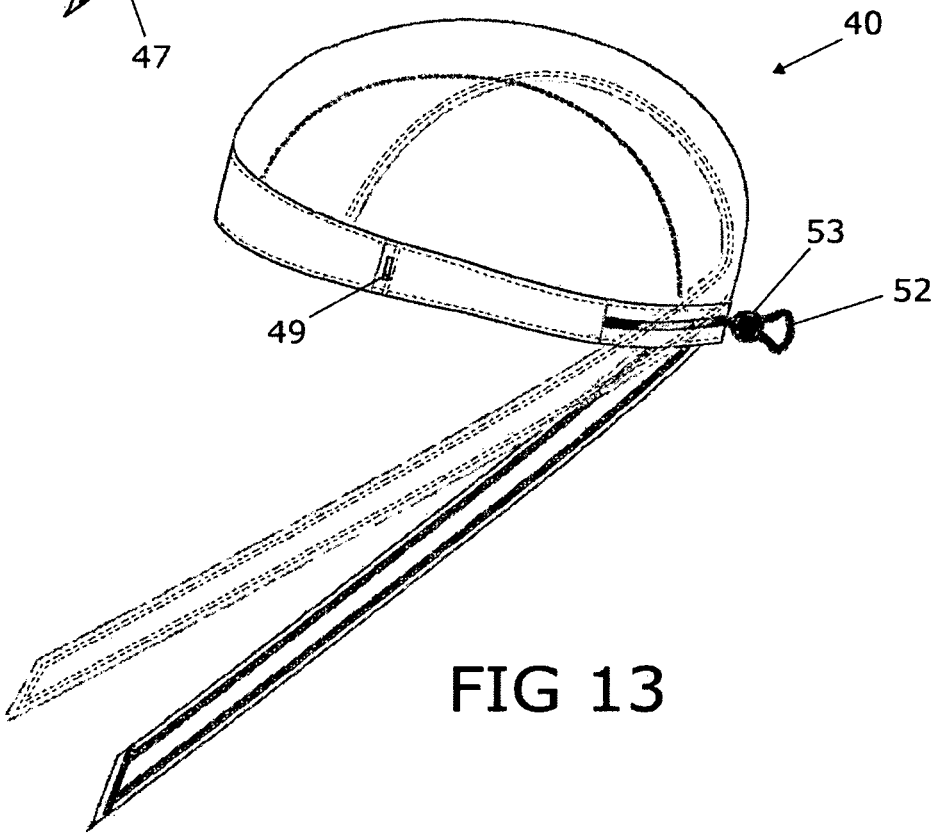
FIG. 13 is an internal view of FIG. 12.

As shown in FIGS. 1-11, head wrap assembly 10 of the present invention has a flexible, unitary body having a headband portion 11 with two cooperating flaps or wings 12, 13 extending therefrom. The headband structure or portion 11 is constructed to be placed circumferentially around the head of a wearer and having an elastic cord 26 secured within that can be cinched at the nape of a wearer's neck to secure the headband portion and thus the head wrap assembly 10 on the wearer's head. The headband structure has two openings or pockets 20, 21 therein located at the back of a wearer's head and each having a magnet 24, 25 secured within the respective opening. Each flap or wing 12, 13 has a wing-like or generally triangular configuration and is attached along one side to the headband portion and has an endpoint or tip 31, 32 that is located at the other or terminal end of the wing and thus spaced from the head band portion 11. A magnet 22, 23 is shown in FIGS. 2, 4, 6, and 8 located within the endpoint or tip 31, 32 of each wing 12, 13, respectively. FIG. 8A shows alternate fastening structure 29 having hook 38 and bop 39. For example, hook 38 may be secured within each opening or pocket 20,21 and a cooperating fabric loop 39 may be located at the end of each wing to thereby secure the ends of each wing to the headband structure. Any cooperating fastening structure known in the art can be utilized to secure the ends of each wing to the head band structure. A flap structure 14 having a pocket 15 is also attached along one side to the headband structure 11. Headband 11 may be lined, for example with a moisture wicking material, as shown in FIG. 10 as lining 30.

Figure 1:
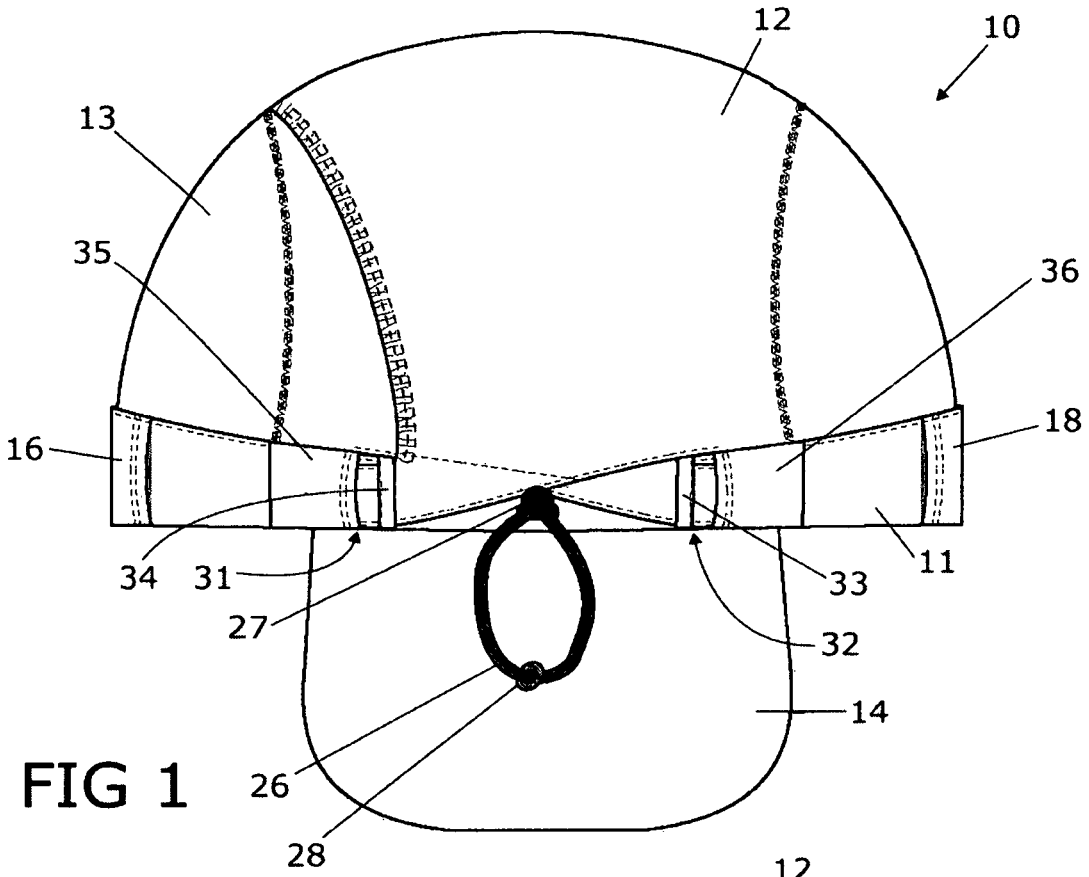
FIG. 1 is a rear view of the head wrap assembly of the invention.
Figure 2:
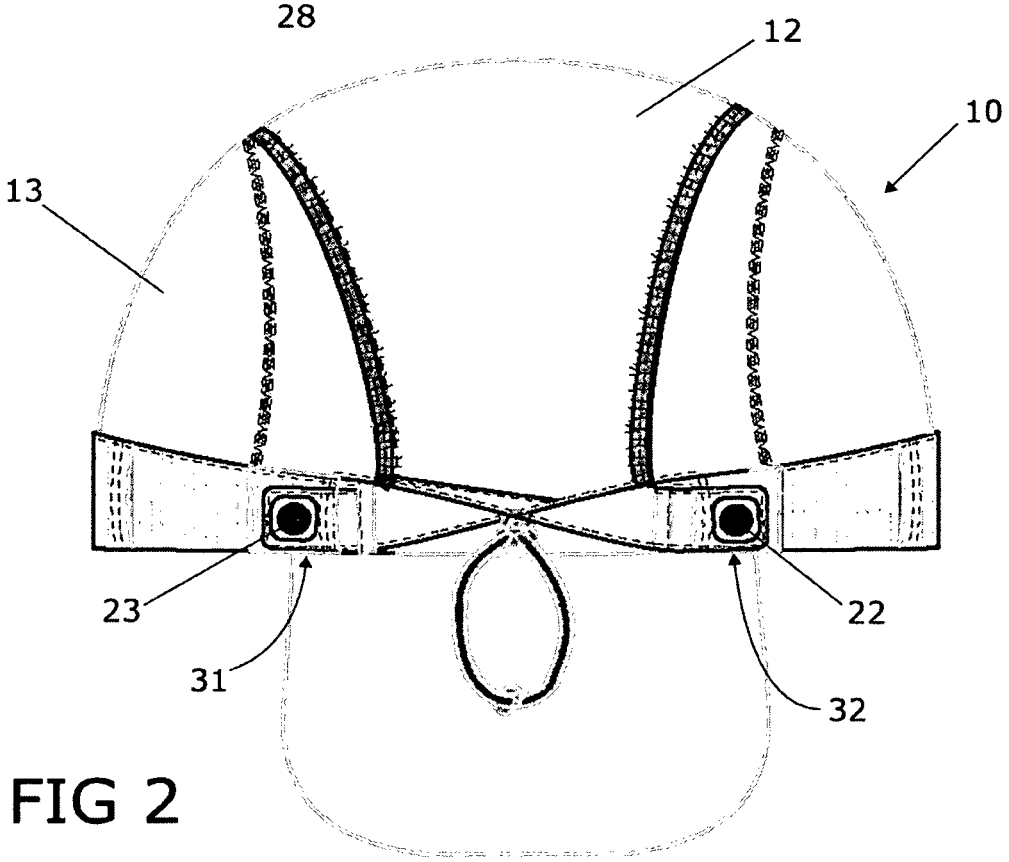
FIG. 2 is an internal view of FIG. 1.

As shown in FIGS. 1 and 2, left side or bottom flap 13 is shown having end 32 which contains magnet 22. After securing the head band 11 on their head using cord/cinch 26 and stop or cord lock 27, a user pulls end 32 of bottom flap 13 across their head, through securement loop 33 and into opening 36 which contains a magnet 24 to secure end 32 within opening 36. Next, a user pulls flap 12 having end 31 with magnet 23, across their head and over bottom flap 13, through securement loop 34, into opening 35 with magnet 25.

Figure 3:
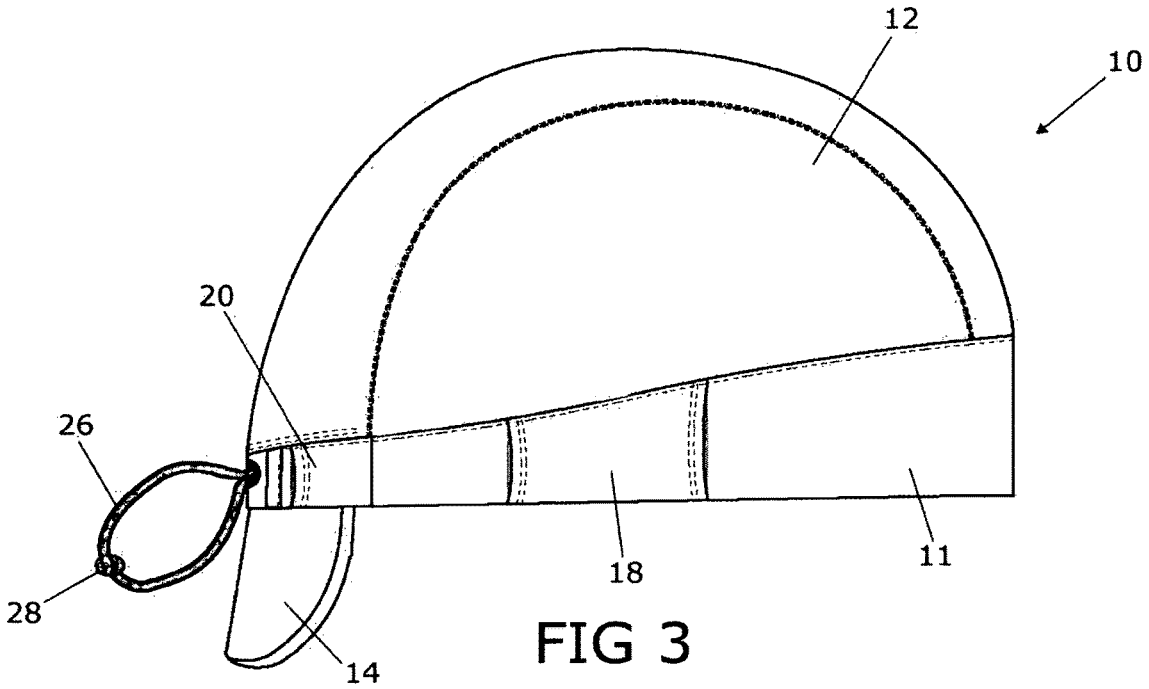
FIG. 3 is a right side view of the head wrap assembly of FIG. 1.
Figure 4:
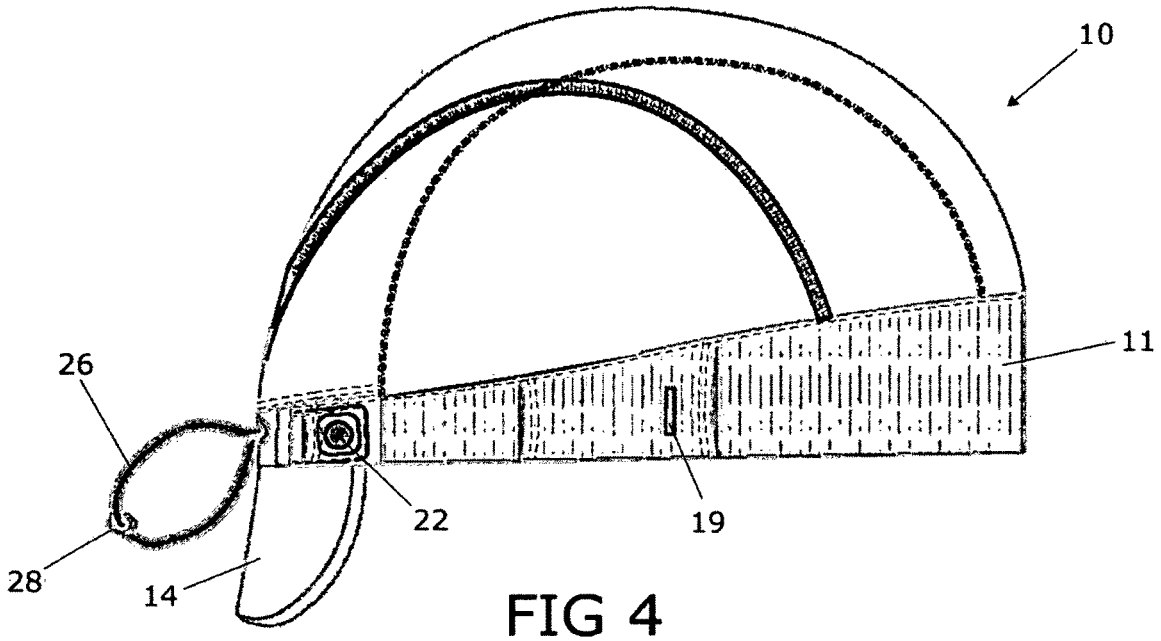
FIG. 4 is an internal view of FIG. 3.
Figure 5:
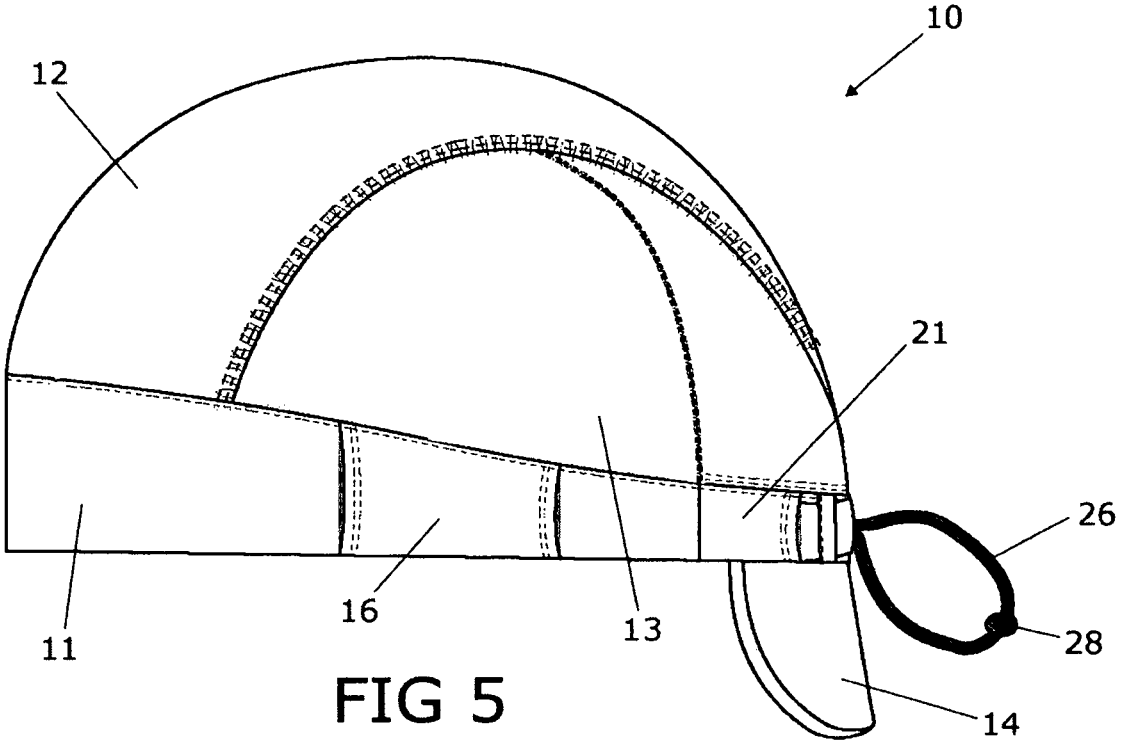
FIG. 5 is a left side view of the head wrap assembly of FIG. 1.

FIGS. 2, 4, and 6 are internal views of FIGS. 1, 3, and 5, respectively, and which show elements such, as magnets 22, 23 and eyelets 17, 19, that are contained within the headwrap assembly 10 or which are obscured by fabric. For, example, eyelets 17, 19 are obscured by and positioned behind fabric pieces 16, 18 and magnets 22, 23 are secured in and located in wing tips 32, 31, respectively, and shown secured in and obscured by pockets 20, 21, respectively.

In use, a user may tuck their hair into the pocket of flap 14. FIG. 7 shows flap 14 having pocket 15 constructed and arranged for receiving a wearer's hair. Hair flap 14 can be worn tucked under flaps 12 and 13 or hanging out under headband 11 at the base of a wearer's neck. Silicone ring 28 is provided for ease of use in grasping cord stop 27 to tighten cinch/cord 26. A head wrap assembly of the invention may be provided without the hair flap with pocket, for example, for a user with short hair or who doesn't want to tuck in their hair.

FIGS. 11A-11E show the head wrap assembly 10 being placed on a wearer's head and in use. As shown in FIG. 11A, a wearer pulls the headband over their head with the wings and flap towards their face and front of their body and with the headband cinch towards the nape of their neck and back of their body, places it around their neck, and pulls their hair through the headband, if applicable. A wearer next pulls the headband upwards and onto their head with the wings and flap towards their forehead/front hairline and with the cinch positioned at the nape of their neck (FIG. 11B). A wearer next tightens the cinch at the nape of their neck to secure the headband on their head. If applicable, as shown in FIG. 11C, a wearer next tucks their hair into the hair flap and pocket. Next, a wearer finds the end/tip of a wing, wraps the wing around their head, and tucks the end through a loop and into the opposite side opening on the headband (FIG. 11D). The magnet contained in the end of the wing tip and the magnet secured within the opening of the headband magnetically engage to hold the wing structure in place (FIG. 11E). The wearer then finds the end/tip of the other wing and wraps the wing around their head and secures the end/tip of the wing in the opening of the headband on the opposite side of their head using the corresponding magnets secured respectively therein (FIGS. 11F, G, H). As shown in FIG. 11H, a wearer may place the temples of their eyeglasses through the eyelets in the headband structure.

Figure 14:
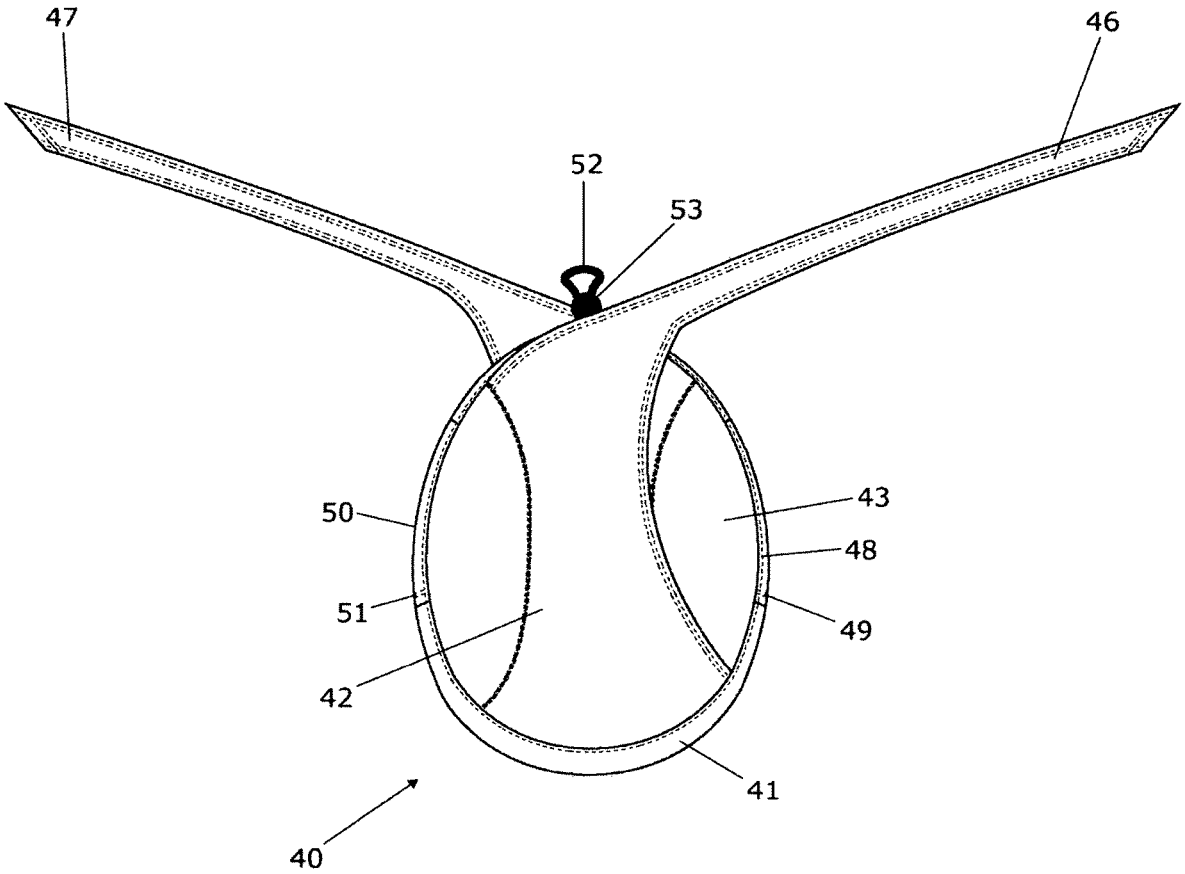
FIG. 14 is a top view of the embodiment of FIG. 12.
Figure 15:
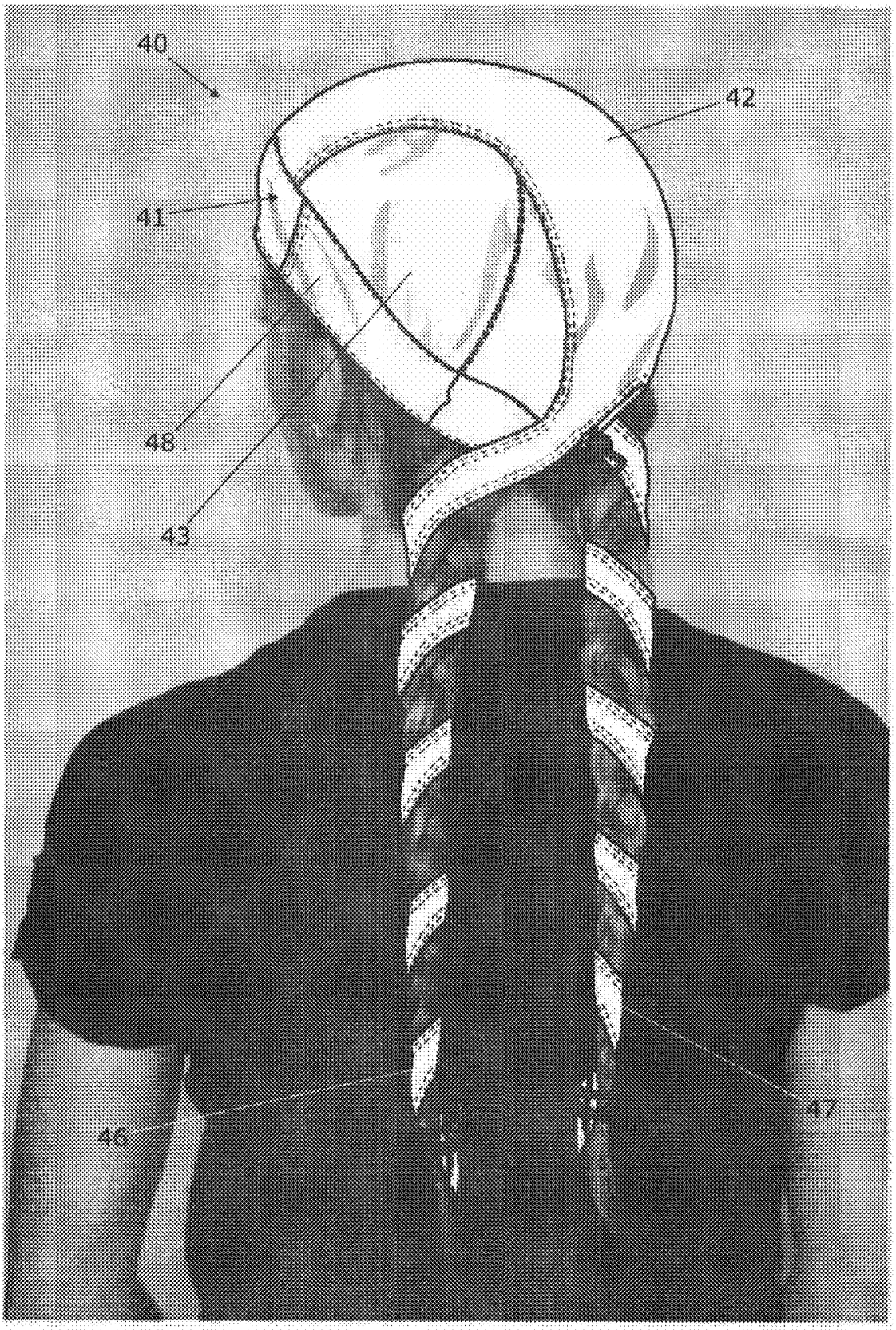
FIG. 15 shows the embodiment of FIG. 12 in use.

As shown in FIGS. 12-15, another embodiment 40 of the head wrap assembly of the invention is constructed for use with a wearer who is wearing their hair in one or more pigtails or braids. The head wrap assembly 40 has a unitary flexible body made of a headband portion 41 with two wing structures 42, 43 attached thereto. Each wing structure has an elongated end 46, 47 that may be wrapped or incorporated into a braid or pigtail of a wearer. The headband is constructed to be placed circumferentially around the head of a wearer and has an elastic cord 52 secured within that can be cinched using cord stop 53 at the nape of a wearer's neck to secure the headband portion 41 on a wearer's head. As shown in FIG. 15, wing ends 46 and 47 can be braided into a wearer's braids and secured. Fabric piece 48 is shown and which conceals eyelet 49 for the ends of a wearer's eyeglasses. Fabric piece 50 is shown in FIG. 14 and which conceals eyelet 51 for the other end of a wearer's eyeglasses.

Figure 16:
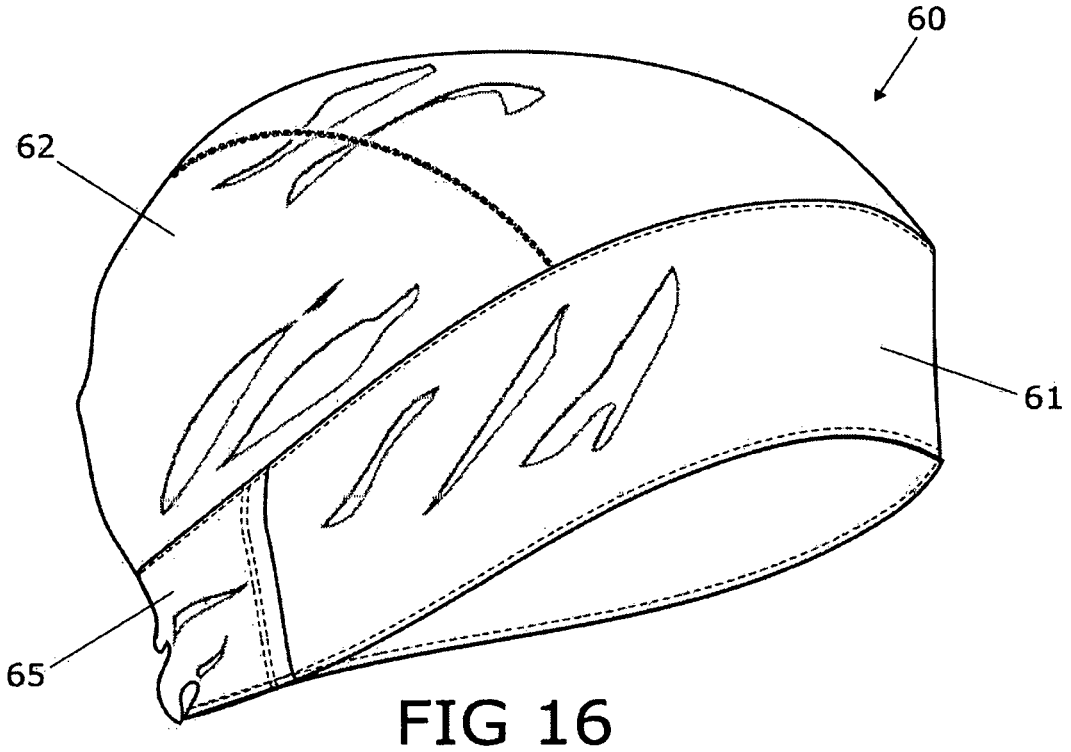
FIG. 16 is a front perspective view of another embodiment of a head wrap assembly of the invention.
Figure 17:
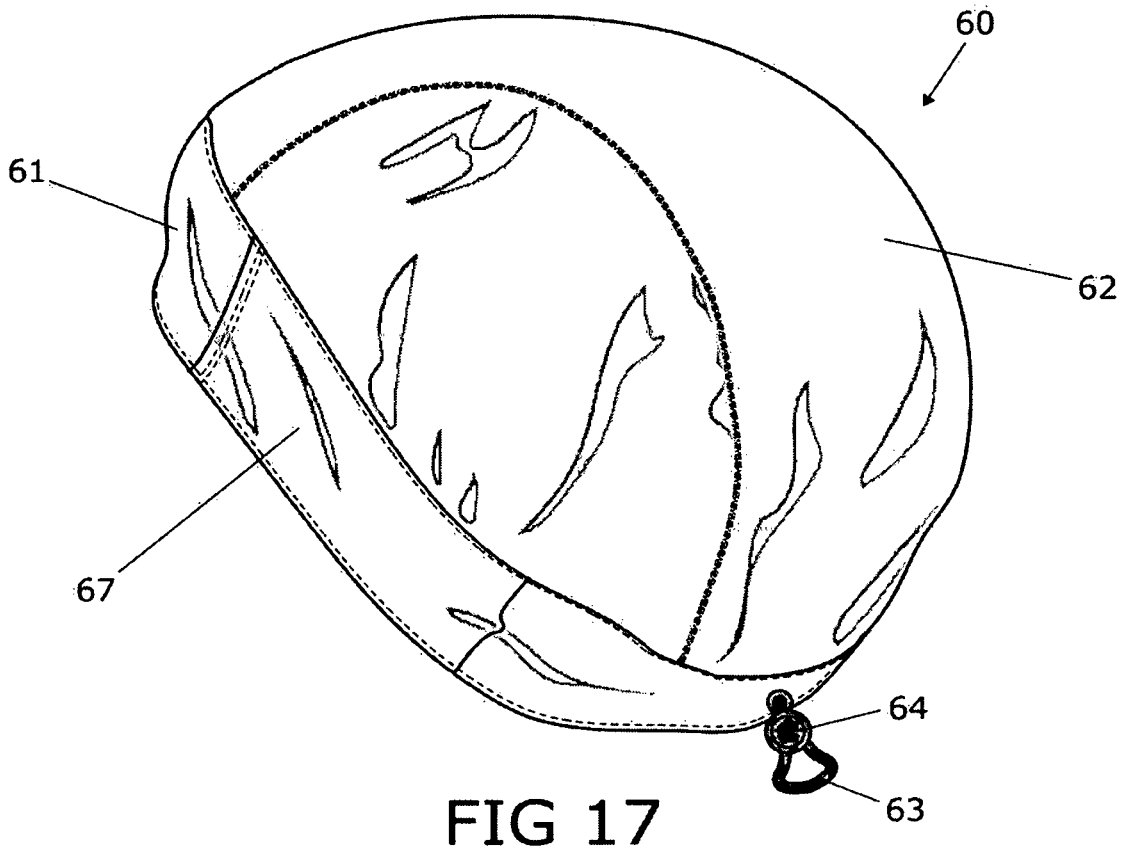
FIG. 17 is a rear perspective view of the embodiment of FIG. 16.
Figure 18:
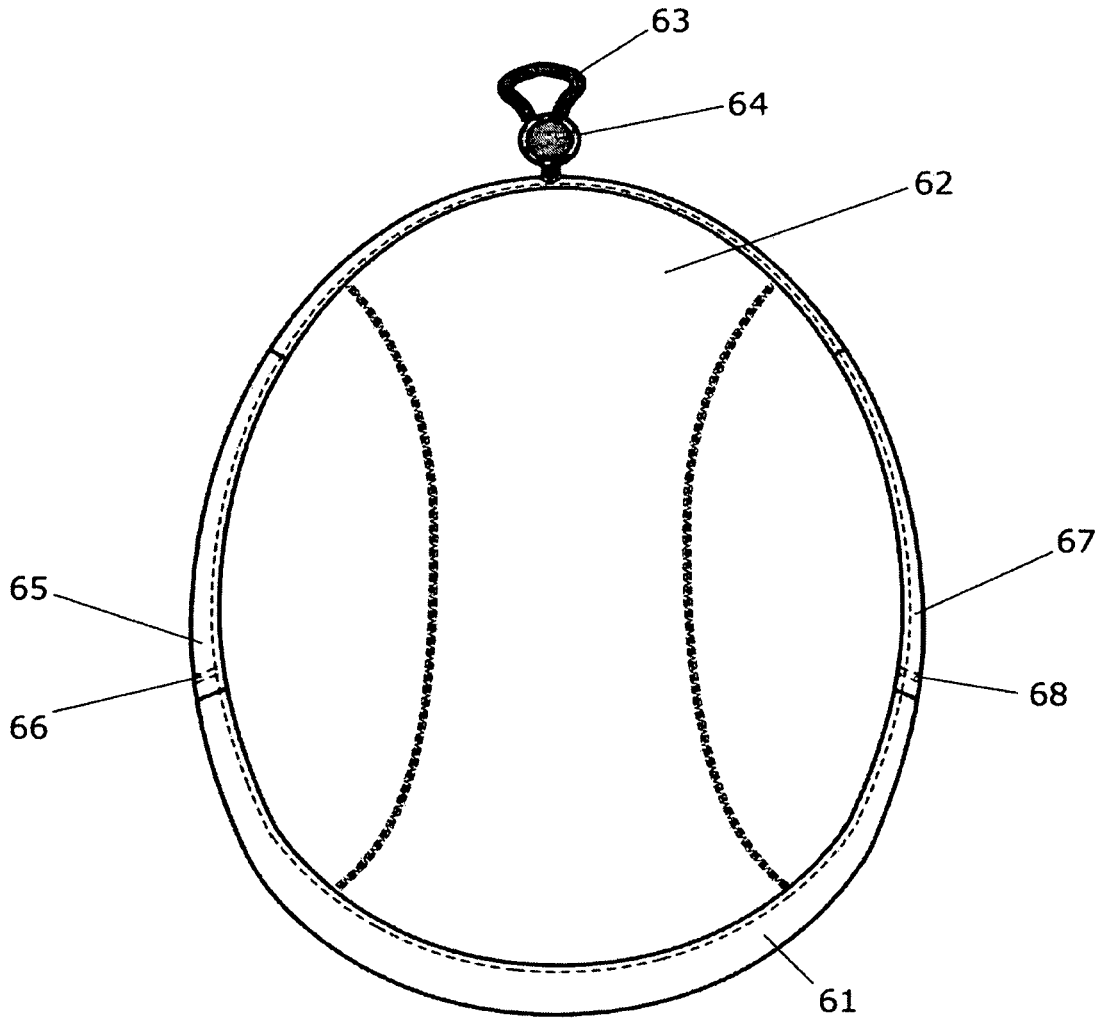
FIG. 18 is atop view of the head wrap assembly embodiment of FIG. 16.

As shown in FIGS. 16-18, a headband structure 61 with a cord/cinch has a head covering or top portion 62 attached thereto thereby creating a beanie-like structure 60. Cord stop 64 is provided to tighten cord/cinch 63 on a wearer's head. Fabric coverings 65, 67 and eyeglass eyelets 66, 68 are also provided for receiving the temples of a wearer's eyeglasses.

Exterior hardware may be provided on the headband portion of a head wrap assembly for use to attach facial protection, for example, PPE (personal protection equipment) used in the medical field or facial coverings to shield the wearer's nose and mouth. The exterior hardware may be buttons or hooks for an elastic from the PPE to attach to instead of a wearer's ear or may be a button hole to which to hook or tie PPE.

The head wrap of the invention is preferably made of fabrics having sweat or moisture wicking, UV protective and/or anti-flammable properties. Exemplary fabrics include materials having four-way stretch, such as wool, fleece, wind/rain proof/resistant, flannel, lace, leather, bamboo, silk, etc.

The head wrap of the invention may be provided without the eyewear slots described above. It is further within the purview of the invention to provide embodiments of the head wrap assembly without magnet securement structures and instead to tie the ends of the wing flaps together to secure the head wrap structure on a wearer's head. Alternate securement structures known in the art may also be utilized instead of cooperating magnet structures, for example, hook and loop or hook and eye securement systems and the like. Additionally, the head wrap assembly may have the ear area of the headband assembly cut out completely and/or made of a very like weight fabric, such as sweatband/velvet fabric, to be able to wear the headband behind the ear while not having excess fabric bunched behind the ear. Sun protection may also be incorporated into a head wrap assembly, for example a visor or bill.

It is further within the purview of the invention to provide an embodiment of the head wrap assembly having the headband portion described above having a fabric tube extending therefrom. In this exemplary embodiment a wearer's hair, if long enough, may extend through the end of the fabric tube, if desired. A cutaway or opening may be located along the headband at the base of the wearer's neck and may be utilized to pull the fabric tube through to thereby secure the fabric tube and the wearer's hair, if long.

As many changes are possible to the head wrap assembly embodiments of this invention utilizing the teachings thereof, the descriptions above, and the accompanying drawing should be interpreted in the illustrative and not in the limited sense.

That which is claimed is:

1. A flexible, unitary bead wrap assembly comprising:

a. a head band structure having means to secure said head band structure circumferentially around a wearer's head, said means to secure said head band structure being operable at a nape of the wearer's neck, said head band structure further containing a first cooperating fastening structure and a second cooperating fastening structure each spaced on either side of said means to secure and for positioning on either side of the nape of the wearer's neck;

b. a first generally triangular wing structure attached to and extending from said head band structure, said first generally triangular wing structure having a terminal end containing a first fastening structure;

c. a second generally triangular wing structure attached to and extending from said head band structure, said second generally triangular wing structure having a terminal end containing a second fastening structure; and d. wherein said first wing structure is constructed to be wrapped across a wearer's head and secured to said first cooperating fastening structure of said head band structure on one side of the nape of the wearer's neck and said second wing structure is constructed to be wrapped across a wearer's head and overlapping said first wing structure and secured to said second cooperating fastening structure of said head band structure on a different side of the nape of the wearer's neck and spaced from said first cooperating fastening structure and to thereby secure said first and second wing structures on either side of the nape of the wearer's neck and to secure a wearer's hair within the head wrap assembly and underneath the first and second wing structures.

2. The head wrap assembly of claim 1, wherein said head band structure has two openings therethrough constructed and arranged to engage temples of a wearer's eyeglasses.

3. The head wrap assembly of claim 1, wherein said means to secure said head band assembly circumferentially around the wearer's head is an elastic cinch.

4. The head wrap assembly of claim 1, wherein said generally triangular first wing structure is secured along one side of said first wing structure along the head band structure and said generally triangular second wing structure is secured along one side of said second wing structure along the head band structure.

5. The head wrap assembly of claim 1, wherein said fastening structures of said terminal ends of said first and second wing structures are selected from the group of fasteners consisting of a magnet, a hook and a fabric loop and wherein said first and second cooperating fastening structures are selected from the group of corresponding fasteners consisting of a magnet, a fabric loop and a hook.

6. The head wrap assembly of claim 1, wherein said head wrap assembly further comprises a flap extending from said head band structure having a pocket to contain the wearer's hair.

7. The head wrap assembly of claim 1, wherein said head wrap assembly is constructed from a fabric having a property selected from the group of properties consisting of UV resistant, sweat wicking and flame retardant properties.

8. A flexible, unitary head wrap assembly comprising:

a. a head band structure having means to secure said head band structure circumferentially around a wearer's head and having two openings therethrough constructed and arranged to engage the temples of a wearer's eyeglasses, and having two magnets contained therein, said magnets being spaced from each other, said magnets being positioned within said head band structure for positioning on either side of nape of a neck of the wearer;

b. a generally triangular first wing structure attached to and extending from said head band structure, said first wing structure having a terminal end containing a magnet;

c. a generally triangular second wing structure attached to and extending from said head band structure, said second wing structure having a terminal end containing a magnet; and d. wherein said magnets in said terminal ends of said first and second wing structures are constructed to be aligned and secured to said spaced magnets contained in said headband structure by pulling each said first and second wing structure over and across the wearer's head to either side of the nape of neck of the wearer to thereby secure said first and second wing structures on either side of the nape of the wearers neck and thereby secure all of the wearer's hair underneath said head wrap assembly.

9. The head wrap assembly of claim 8, wherein said means to secure said head band assembly is an elastic cinch.

10. The head wrap assembly of claim 8, wherein said head wrap assembly further comprises a flap having a pocket to contain the wearer's hair.

11. The head wrap assembly of claim 8, wherein said head wrap assembly is constructed from a fabric selected from the group of fabrics consisting of a UV resistant fabric, a sweat wicking fabric and a flame retardant fabric.

12. The head wrap assembly of claim 8, wherein said generally triangular first wing structure is secured along one side of said first wing structure along the head band structure and said generally triangular second wing structure is secured along one side of said second wing structure along the head band structure.

13. A flexible, unitary head wrap assembly comprising:

a. a head band structure having means to secure said head band structure circumferentially around a wearer's head, said head band structure having a first fastening member secured to said head band structure and a second fastening member secured to said head band structure and spaced from said first fastening member, said first and second fastening members adapted to be spaced on either side of the wearer's nape of neck;

b. a generally triangular first wing structure attached to and extending from said head band structure, said first wing structure having a terminal end containing a first wing fastening member, wherein one side of said generally triangular first wing structure is attached to said head band structure for positioning along a forehead of the wearer's head;

c. a generally triangular second wing structure attached to and extending from said head band structure, said second wing structure having a terminal end containing a second wing fastening member, wherein one side of said second generally triangular wing structure is attached to said head band structure for positioning along the forehead of the wearer's head and wherein said second wing structure overlaps said first wing structure; and d. wherein said first wing fastening member and said second wing fastening member in said terminal ends of said first and second wing structures are constructed to be aligned and secured to said spaced first and second fastening members of said head band structure to thereby secure each wing structure around the wearer's head and thereby secure all of a wearer's hair underneath said wing structures of said head wrap assembly.

14. The head wrap assembly of claim 13, wherein said head band structure further has two openings therethrough constructed and arranged to engage temples of the wearer's eyeglasses.

15. The head wrap assembly of claim 13, wherein said means to secure said head band assembly is an elastic cinch.

16. The head wrap assembly of claim 13, wherein said head wrap assembly further comprises a flap having a pocket to contain the wearer's hair.

17. The head wrap assembly of claim 13, wherein said spaced first and second fastening structures are selected from the group of fasteners consisting of a magnet, a fabric loop and a hook and wherein said first wing fastening member and said second wing fastening member in said terminal ends of said first and second wing structures are selected from the group of corresponding fasteners consisting of a magnet, a hook and a fabric loop.

18. The head wrap assembly of claim 13, wherein said first fastening member of said head band is secured within a pocket on said head band structure and configured to be positioned approximately behind an ear of the wearer and wherein said second fastening member of said headband is secured within a pocket on said head band structure and configured to be positioned approximately behind another ear of the wearer.

19. The head wrap assembly of claim 18, wherein a first securement loop is provided on said head band structure near said first fastening member pocket and wherein a second securement loop is provided on said head band structure near said second fastening member pocket.

* * * * *